US005202953A

United States Patent [19]

Taguchi

[11] Patent Number: 5,202,953

[45] Date of Patent: Apr. 13, 1993

[54] MULTI-PULSE TYPE CODING SYSTEM WITH CORRELATION CALCULATION BY BACKWARD-FILTERING OPERATION FOR MULTI-PULSE SEARCHING

[75] Inventor: Tetsu Taguchi, Tokyo, Japan

[73] Assignee: NEC Corporation, Tokyo, Japan

[21] Appl. No.: 823,615

[22] Filed: Jan. 21, 1992

Related U.S. Application Data

[63] Continuation of Ser. No. 534,308, Jun. 7, 1990, abandoned, which is a continuation of Ser. No. 179,455, Apr. 18, 1988, abandoned.

[30] Foreign Application Priority Data

Apr. 8, 1987 [JP] Japan ..... 62-87669

[51] Int. Cl.[5] ..... G10L 9/08

[52] U.S. Cl. ..... 395/2

[58] Field of Search ..... 381/29-40, 381/48-50; 395/2

[56] References Cited

U.S. PATENT DOCUMENTS

| | | | |
|---|---|---|---|
| 4,220,819 | 9/1980 | Atal | 381/38 |
| 4,282,405 | 8/1981 | Taguchi | 381/40 |
| 4,379,949 | 4/1983 | Chen et al. | 375/122 |
| 4,536,886 | 8/1985 | Papamichalis et al. | 381/41 |
| 4,669,120 | 5/1987 | Ono | 381/40 |
| 4,716,592 | 12/1987 | Ozawa et al. | 381/40 |
| 4,724,535 | 2/1988 | Ono | 381/31 |
| 4,752,956 | 6/1988 | Sluijter | 381/49 |
| 4,797,926 | 1/1989 | Bronson et al. | 381/38 |
| 4,821,324 | 4/1989 | Ozawa et al. | 381/31 |

OTHER PUBLICATIONS

Berouti et al., "Efficient Computation and Encoding of the Multipulse Excitation for LPC", IEEE ICASSP84, Mar. 19-21, 1984, pp. 10.1.1-10.1.4.

Makhoul, "Linear Prediction: A Tutorial Review", Proc. IEEE, vol. 63, Apr. 1975, pp. 561-580.

Kroon et al., "On the Design of LPC-Vocoders with the Multi-Pulse Excitation", Proc. of the Sixth ECCTD '83, Sep. 6-8, 1983, pp. 390-394.

Kroon et al., "Experimental Evaluation of Different Approaches to the Multi-Pulse Coder", IEEE ICASSP '84, Mar. 19-24, 1984, pp. 10.4.1-10.4.4.

*Primary Examiner*—David D. Knepper

*Attorney, Agent, or Firm*—Sughrue, Mion, Zinn, Macpeak & Seas

[57] ABSTRACT

Speech signal encoding at a low bit rate is realized by decreasing the number of arithmetic operations required to determine LPC parameters in a backward processing unit. These parameters are determined and updated by filtering, rather than by impulse response. In this manner, it is not necessary to use previously-calculated parameters in updating.

5 Claims, 3 Drawing Sheets

MULTI-PULSE TYPE CODING SYSTEM WITH CORRELATION CALCULATION BY BACKWARD-FILTERING OPERATION FOR MULTI-PULSE SEARCHING

This is a continuation of application Ser. No. 07/534,308, filed Jun. 7, 1990, now abandoned, which is a continuation of application Ser. No. 07/179,455, filed Apr. 18, 1988, now abandoned.

BACKGROUND OF THE INVENTION

The present invention relates to a multi-pulse type coding system and, more particularly, to a multi-pulse type coding system for coding a speech signal at a low bit rate (a low transmission rate).

There are two main methods for efficient coding of an input speech signal. One is a spectral coding method which codes a spectral structure of the speech signal, and the other is a waveform coding method which codes a waveform of the speech signal itself. The spectral coding method is capable of transforming a speech signal at a remarkably low bit rate, e.g., 4.8 Kb/s, but degrades the quality of a duplicate speech waveform. On the other hand, the waveform coding method is capable of realizing a duplicate speech signal of relatively higher quality. However, the coding bit rate according to the waveform coding method is generally higher than that by the spectral coding method.

In the waveform coding method, an input speech signal is whitized so as to improve coding efficiency. This whitizing operation performs flattening of a spectral structure of the speech signal. Information on the spectral speech structure is, otherwise, required for reproducing the speech signal. In the waveform coding method, generally speaking, the spectral structure of the speech signal is transmitted by utilizing the spectral coding method.

In the waveform coding method, when a whitized speech signal is coded, an amount of information after coding depends upon a degree of whitizing. That is, the higher the degree of whitizing, the less the amount of information necessary for coding the whitized speech signal.

Multi-pulse type coding is known as one of the more efficient waveform coding methods. In multi-pulse type coding, the spectral structure of the speech signal is expressed by a set of Linear Predictive Coding (LPC parameters. On the other hand, the whitized speech signal is additionally expressed by a plurality of excitation pulses (multi-pulses) featured by their amplitudes and their position during a frame period. Such multi-pulse type coding is disclosed in U.S. Pat. Nos. 4,282,405, No. 4,472,832 and No. 4,701,954, for example.

One subject in the multi-pulse type coding is to reduce an arithmetic amount necessary for searching the multi-pulses. As a solution for this subject, there is known a method of searching the multi-pulses through cross-correlation calculation. In this method, the search of the multi-pulses is performed by considering correlations between a filtered impulse response waveform derived from the LPC parameters and the speech signal. Therefore, it is necessary to determine LPC parameters in a period sufficiently exceeding a duration time of an impulse response. Accordingly, the LPC parameters have been conventionally updated every 20 msecs, for example.

In order to precisely express the spectral structure of a speech signal, it is empirically known that a shorter period, e.g., about 5 msecs is preferable for updating the LPC parameters. However, for the aforementioned reason, the updating period of the LPC parameters has to be set at about 20 msecs in the multi-pulse type coding, limiting the expressiveness of the spectral structure. As a result, the coding efficiency is limited to a coding bit rate of about 8 Kb/s to maintain the coding quality. Namely, when the multi-pulse type coding of a coding rate less than 8 Kb/s is applied, the coding quality cannot be retained but may be inferior to that by the spectral coding method.

SUMMARY OF THE INVENTION

An object of the present invention is to provide a multi-pulse type coding system which is capable of keeping a practically sufficient quality even when a lower bit rate, e.g., a bit rate less than 8 Kb/s is applied for coding.

According to the present invention, there is provided a multi-pulse type coding system in which an update period of LPC parameters for searching multi-pulses (excitation pulses) is shortened. The multi-pulse type coding system of the present invention comprises an LPC analyzer for producing LPC parameters indicative of a spectral envelope of a speech signal for each search frame period, an interpolator for producing a plurality of interpolated LPC parameters during the search frame period in response to the LPC parameters, a filtering processor for calculating cross-correlation between the speech signal and an impulse response signal associated with the LPC parameters by filtering the speech signal in accordance with the interpolated parameters, and multi-pulse calculating means for calculating multi-pulses in response to the correlation.

DESCRIPTION OF THE PREFERRED EMBODIMENTS

First of all, the summary of the present invention will be described in the following.

According to the present invention, in multi-pulse type coding at a relatively low bit rate, an updating period of a spectral envelope parameter is set to be shorter than a frame period for searching the multi-pulses in order to enhance the expressiveness of the spectral envelope.

Accordingly, respective spectral envelope parameters can be obtained for individual plural blocks in one frame period so that the spectral envelope information can be expressed more reliably. In other words, a low bit rate coding for a narrow frequency band can be accomplished while applying the multi-pulse type coding.

The embodiment of the present invention will be described with reference to FIGS. 1 to 4, hereinafter.

Figure 1:
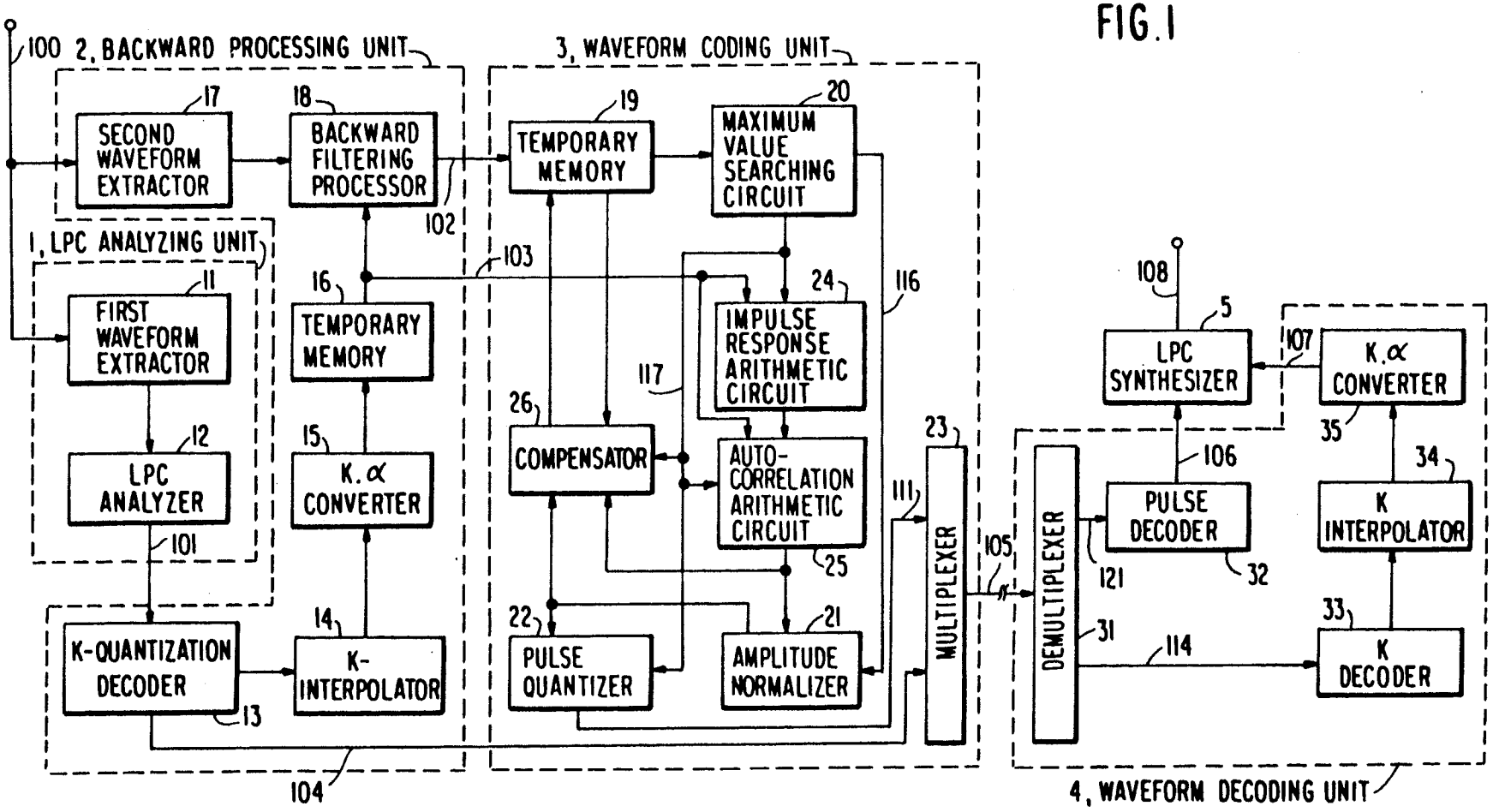
FIG. 1 is a block diagram showing one embodiment of a multi-pulse type coding system according to the present invention.

As shown in FIG. 1, the multi-pulse type coding system of the present invention comprises an LPC analyzing unit 1, a backward processing unit 2, a waveform coding unit 3, a waveform decoding unit 4 and an LPC synthesizer 5. These individual circuit components will be described in detail in the following.

Figure 2:
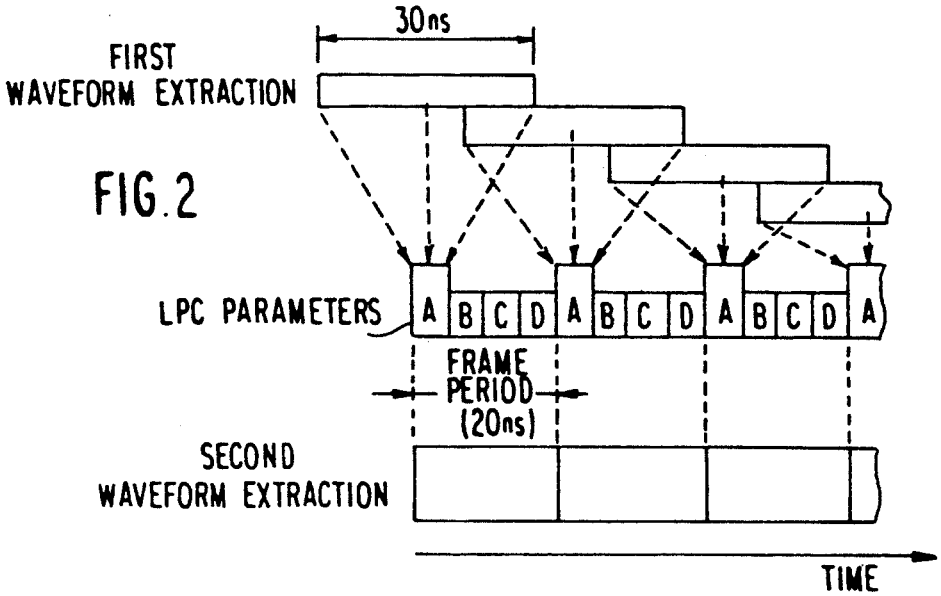
FIG. 2 is a diagram for explaining a frame extraction operation in the coding system of the present invention.

A digitized input speech signal 100 is supplied to the LPC analyzing unit 1 and the backward processing unit 2. The LPC analyzing unit 1 comprises a first waveform extractor 11 and an LPC analyzer 12. In this unit 1, a frame period for producing LPC parameters to be transmitted and for searching multi-pulses is set to be 20 msecs. However, as shown in FIG. 2, the first waveform extractor 11 segments the input speech signal into a period of 30 msecs in an overlapped manner, for example, and supplies the segmented speech signal to the LPC analyzer 12. As a result, the LPC analyzer 12 produces LPC parameters A associated with each frame period of 20 msecs, as shown in FIG. 2, and delivers an LPC parameter signal 101 indicative of the LPC parameters A to a K-quantization decoder 13 in the backward processing unit 2.

The backward processing unit 2 comprises the K-quantization decoder 13, a K-interpolator 14, a K.α-converter 15, a temporary memory 16, a second waveform extractor 17 and a backward filtering processor 18. In this unit 2, the LPC parameter signal 101 is supplied to the K-quantization decoder 13 and the quantized LPC parameter signal 104 delivered from the decoder 13 is outputted to a multiplexer 23 in the waveform coder 3 to be transmitted. Moreover, the LPC parameter signal thus quantized and decoded is supplied from the decoder 13 to the K-interpolator 14.

The K-interpolator 14 produces a plurality of interpolated LPC parameters during each frame period of 20 msec on the basis of two successively supplied LPC parameters A. In this interpolator 14, as shown in FIG. 2, three interpolated LPC parameters B, C and D are produced from two adjacent LPC parameters of two adjacent frame periods and, thus, four respective LPC parameters A, B, C and D are obtained during each frame period. Generally, the LPC parameters include a plurality of coefficient data associated with respective orders and, therefore, the interpolating calculation using a linear interpolation method, for example, is performed for the respective coefficient data in practice. Also, other various interpolation methods can be applied to the interpolating calculator and, further, it is possible to produce interpolated LPC parameters from more than two LPC parameters, i.e., from more than two frame periods. The plurality of LPC parameters A, B, C and D from the K-interpolator 14 are supplied through the K.α-converter 15 to the temporary memory 16.

Next, the backward filtering processor 18 for equivalently producing the cross-correlation between the speech signal and an impulse response associated with LPC parameters will be described, hereinafter.

The first step of the multi-pulse search is to determine the cross-correlation between an impulse response of a LPC synthesizing filter, which is based upon the result of the LPC analysis of the input speech signal, and the input speech signal. For this first step, there are calculated products between the value of a certain time of the input speech signal and the values of the individual points (i.e., slots split from a predetermined block) of the predetermined block of the impulse response signal of the filter, which are constructed on the basis of the result of the LPC analysis of the input speech signal. For each of these products, a sum is calculated of the predetermined block. This sum is the cross-correlation signal between the input speech signal and the impulse response. Conventionally, the aforementioned calculation requires a great number of arithmetic operations. Moreover, if the coefficient of the LPC synthesizing filter is frequently updated during the impulse response, the calculation to obtain the impulse response should be done at 160 sample points to compute the cross-correlation during one frame period, in a case the sampling frequency of 8 KHz and the frame period of 20 msecs are applied. Therefore, the arithmetic amount further increases. This increase of the arithmetic amount is one reason that the search period of the LPC parameters could not be shorter than the frame period in the prior art. This problem is solved in the present invention by using a filtering operation instead of using the impulse response to compute the cross-correlation.

It is assumed that the impulse response of a LPC synthesizing filter is indicated by $I_i$ (i=0, 1, 2, . . . ), the output at a time point j corresponding to the filter input "1" at a time point j-k is expressed by $I_k$, and the output corresponding to a filter input $S_k$ is expressed by $I_k \cdot S_k$. When the filter inputs $S_0, S_1, S_2, \ldots, S_k$, and so on are applied at time points j, j-1, j-2, . . . , j-k, and so on, the filter output $B_j$ at the time point j is expressed by the following formula (1):

$$B_j = \sum_{l=0}^{N} I_l \cdot S_l \qquad (1)$$

This formula (1) implies that the correlation between the speech waveform samples $S_0, S_1, S_2, \ldots, S_k$, and so on and the filtered impulse response $I_i$ can be determined as an output of a IIR (infinite impulse response) filter. In this case, the input order of the speech waveform samples to the filter is directed backward, i.e., from a future sample to a past sample. Further, it is quite apparent according to this method that the filter output $B_{j-1}$ at the time point j-1 is outputted continuously as a filter output after the output $B_j$ and that the arithmetic amount does not increase even if filter coefficients are updated midway.

Referring back to FIG. 1, the temporary memory 16 stores the LPC parameters including the interpolated parameters. The LPC parameters 103 for each frame period are read out in the reverse sequence order, as shown in FIG. 3(*a*), from the memory 16 and supplied to the backward filtering processor 18 and to an impulse response arithmetic circuit 24 and an autocorrelation arithmetic circuit 25 in the waveform coding unit 3.

In response to the input digitized speech signal 100, on the other hand, a second waveform extractor 17 extracts each segmented signal of the frame period of 20 msecs, as shown in FIG. 2, in synchronism with the operation of the first waveform extractor 11. In this case, the segmented speech signal is delivered from the extractor 17 to the backward filtering processor 18 in the reverse time direction in synchronism with the operation of the processor 18.

Figure 3A:
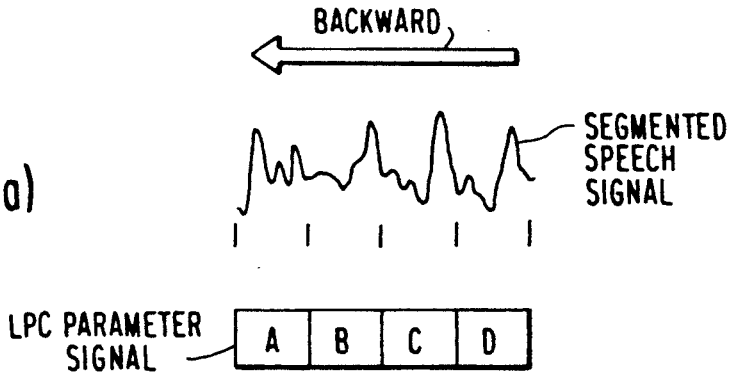
FIGS. 3(*a*) and 3(*b*) are explanatory diagrams showing a backward filtering processor according to the present invention.
Figure 3B:
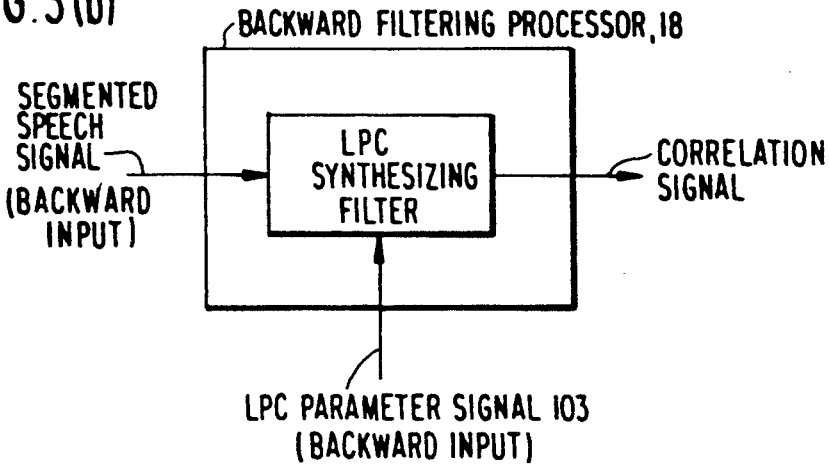
Figure 4A:
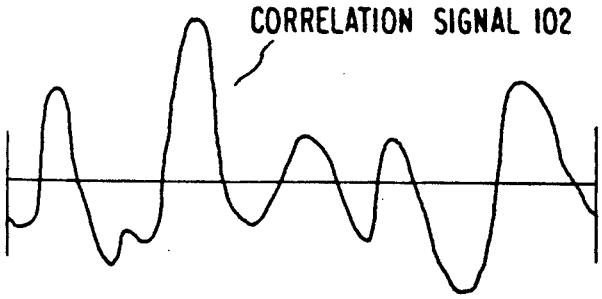
FIGS. 4(*a*) to (*f*) are diagrams for explaining the operations of an impulse response unit in the embodiment of the present invention.
Figure 4B:
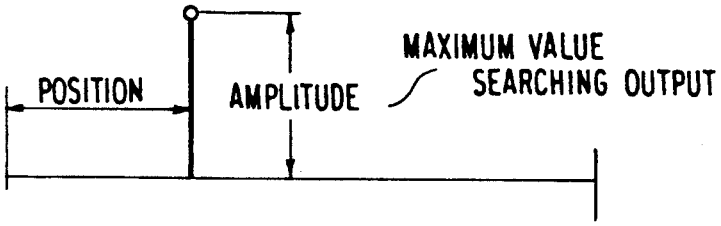
Figure 4C:
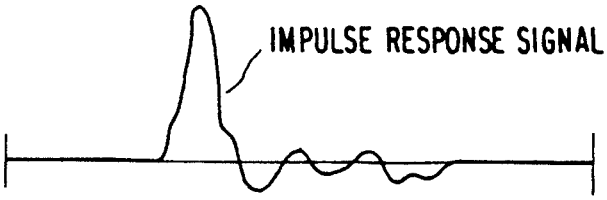
Figure 4D:
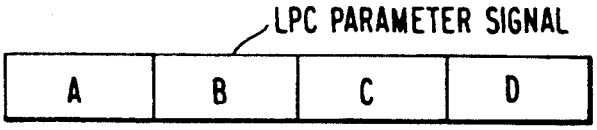
Figure 4E:
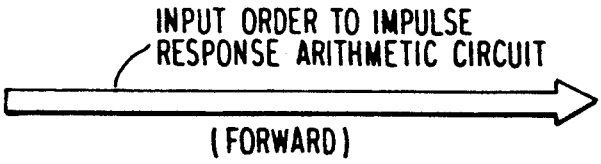
Figure 4F:
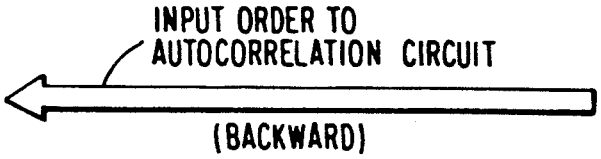

The backward filtering processor 18 is constructed, as shown in FIG. 3(*b*), of an LPC synthesizing filter which is controlled by the LPC parameters 103 for each frame period. As described above, the LPC parameters 103 are inputted in the backward manner (i.e., while having the leading and trailing ends of the signal reversed). On the other hand, the input speech signal for each frame period delivered from the second waveform extractor 17 is inputted in the backward manner to the backward filtering processor 18. Here, the relation between the LPC parameters A, B, C and D during one frame period and the input speech signal of one frame period are shown in FIG. 3(*a*). In this way, a cross-correlation signal 102 representative of the cross-correlation between the impulse response of the LPC synthesizing filter and the input speech signal is obtained for each frame period and supplied to a temporary memory 19 in the waveform coding unit 3.

Next, this waveform coding unit 3 will be described in the following. This coding unit 3 is composed of the temporary memory 19, a maximum value searching circuit 20, an amplitude normalizer 21, a pulse quantizer 22, the multiplexer 23, the impulse response arithmetic circuit 24, the autocorrelation arithmetic circuit 25 and a compensator 26.

When the cross-correlation signal 102 of one frame is stored in the temporary memory 19, as shown in FIG. 4(*a*), it is supplied to the maximum value searching circuit 20, in which the amplitude and the position in the frame period associated with the maximum value of the cross-correlation signal is searched, as shown in FIG. 4(*b*). As a result, a position signal 117 is supplied to the impulse response arithmetic circuit 24, the autocorrelation arithmetic circuit 25 and the compensator 26, and an amplitude signal 116 is supplied to the amplitude normalizer 21.

The impulse response arithmetic circuit 24 receives the LPC parameters 103 shown in FIG. 4(*d*) and the position signal 117. Thus, the impulse response arithmetic circuit 24 calculates the impulse response of the corresponding LPC synthesizing filter, in the normal (forward) order, as indicated by an arrow in FIG. 4(*e*). To this end, the impulse response arithmetic circuit 24 temporarily stores the LPC parameters 103 in the backward direction delivered from the temporary memory 16 and converts them in the forward direction. The autocorrelation arithmetic circuit 25 receives the LPC parameters 103 shown in FIG. 4(*d*), the impulse response signal obtained by the impulse response arithmetic circuit 24 as shown in FIG. 4(*c*), and the position signal 117. Thus, the autocorrelation arithmetic circuit 25, which has function of backward processing of the autocorrelation filter, calculates the autocorrelation in the backward order as sown in FIG. 4(*f*), so that the autocorrelation signal is obtained and it is supplied to the amplitude normalizer 21 and the compensator 26.

On the other hand, the amplitude signal 116 and the autocorrelation signal are supplied to the amplitude normalizer 21. In the amplitude normalizer 21, the amplitude signal 116 is normalized such that the maximum value of the autocorrelation signal becomes equal to the quantized and decoded amplitude of the amplitude signal 116, and supplied to the pulse quantizer 22 and the compensator 26. The normalized amplitude signal and the position signal 117 are quantized in the pulse quantizer 22. Moreover, the multi-pulse signal 111 which shows the maximum pulse position and its amplitude is supplied to the multiplexer 23.

The autocorrelation signal delivered from the autocorrelation arithmetic circuit 25, the quantized and decoded amplitude signal delivered from the amplitude normalizer 21, and the position signal 117 are supplied to the compensator 26. As a result, this compensator 26 generates an autocorrelation signal in which the maximum amplitude and the position on the frame period are determined upon the reception of those signals.

On the other hand, the cross-correlation signal stored in the temporary memory 19 is read out to the compensator 26, and the aforementioned autocorrelation having the same maximum amplitude and the same position is subtracted from that cross-correlation signal and the result is returned to the temporary memory 19. Next, the cross-correlation signal stored in the temporary memory 19 is read out and supplied to the maximum value searching circuit 20 so that the multi-pulse signal having the second maximum amplitude is obtained from the maximum value searching circuit 20. This procedure is continued until the number of the multi-pulses reaches a predetermined value or until an amplitude of a detected pulse becomes smaller than a predetermined amplitude, so that the multi-pulse signal 111 indicative of a plurality of multi-pulses is completely inputted to the multiplexer 23.

The multiplexer 23 receives the LPC parameter signal 104 and the multi-pulse signal 111 and multiplexes them. The resultant multiplexed signal 105 is outputted from the multiplexer 23 and transmitted to the waveform decoding unit 4 through a transmission line.

Next, the waveform decoding unit 4 will be described in the following. The waveform decoding unit 4 is composed of a demultiplexer 31, a pulse decoder 32, a K-decoder 33, a K-interpolator 34, and a K.α-converter 35. When a multiplexed signal 105 is inputted to the demultiplexer 31 from the waveform decoding unit 3, the demultiplexer 31 outputs both an LPC parameter signal 114 corresponding to the LPC parameter signal 104 and a multi-pulse signal 121 corresponding to the multi-pulse signal 111.

The LPC parameter signal 114 delivered from the demultiplexer 31 is decoded by the K-decoder so that the decoded signal is inputted to the K-interpolator 34. This K-interpolator 34 interpolates the LPC parameter signal of one frame like the aforementioned K-interpolator 14 so that the representative LPC parameter signal is converted by the K.α-converter into a converted LPC parameter signal 107 and supplied to the LPC synthesizer 5. On the other hand, the multi-pulse signal 121 delivered from the demultiplexer 31 is decoded by the pulse decoder 32 into a decoded multi-pulse signal 106, which is then outputted to the LPC synthesizer 5.

The multi-pulse signal 106 is inputted to the LPC synthesizer 5 and controlled in accordance with the LPC parameter signal 107 so that a decoded output digitized speech signal 108 is outputted.

In the embodiment, a plurality of the LPC parameters during one frame period are produced by interpolating the two LPC parameters of adjacent frame periods so as to enhance the expressiveness of the spectral envelope of the input speech signal.

Otherwise, it is also possible to obtain a plurality of the LPC parameters during one frame period by accomplishing a plurality of LPC analyses in one frame period. In this case, high speed arithmetic operation is required in circuit components such as the waveform extractor and the LPC analyzer of FIG. 1. Therefore, when this alternative method is applied, in the block diagram of FIG. 1 showing the structure of the embodiment, the K-interpolators 13 and 34 can be omitted and their input and output terminals are connected directly. However, the LPC analyzing unit 1 has to accomplish the LPC analysis once during each of the segmented portions provided by dividing one frame period to obtain a plurality of the LPC parameters for one frame period. Further, the operations are similar to those of the embodiment except that the LPC parameter signal to pass through the K-quantization decoder 13, the multiplexer 23, the demultiplexer 31 and the K-decoder 33 experiences several updates during the one frame period.

As has been described in detail hereinbefore, according to the present invention, when the speech signal is to be coded into the multi-pulses, in order to attain accurate spectral envelope information, a plurality of the LPC parameters are produced for one frame period. As a result, a low bit rate coding is realized while keeping practically efficient coding quality.

What is claimed is:

1. A multi-pulse type coding system for coding a speech signal into a plurality of pulse signals, comprising:

means for producing one set of parameters indicative of a spectral envelope of said speech signal for each search frame period;

means, coupled to said parameter producing means and responsive to a plurality of sets of parameters, each of said sets of parameters belonging to adjacent search frame periods, for producing a plurality of sets of interpolated parameters during each search frame period;

means for extracting a segmented speech signal from said speech signal and for delivering said segmented speech signal in backward time sequence, said segmented speech signal having a period corresponding to said each search frame period;

means for filtering said segmented speech signal in accordance with a filtering characteristic defined by said set of parameters and said plurality of sets of interpolated parameters during said each search frame period and for directly producing a cross-correlation signal representative of a transition of cross-correlation between said segmented speech signal and an impulse response defined by said set of parameters and said sets of interpolated parameters during said each search frame period, said filtering characteristic being varied during said each search frame period in accordance with a backward time sequence of said set of parameters and said plurality of interpolated parameters, said segmented speech signal being received in backward time sequence; and means for generating said plurality of pulse signals in response to said cross-correlation signal.

2. A multi-pulse type coding system as claimed in claim 1, further comprising means for transmitting said parameters delivered from said parameter producing means and information representative of said plurality of pulse signals.

3. A multi-pulse type coding system as claimed in claim 1, wherein said parameters are LPC coefficients.

4. A multi-pulse type coding system as claimed in claim 1, wherein said means for producing a plurality of sets of parameters includes interpolating means for producing a plurality of interpolated parameters during said search frame period from said parameters associated with two adjacent search frame periods.

5. A multi-pulse type coding system for coding a speech signal into a plurality of pulse signals, comprising:

LPC analyzer means for producing one set of LPC parameters indicative of a spectral envelope of the speech signal for each search frame period;

interpolation means responsive to said one set of LPC parameters and another set of LPC parameters for an adjacent search frame period for producing a plurality of interpolated LPC parameters during said search frame period;

means for receiving said speech signal in backward time sequence;

filter means for backwardly filtering said speech signal under control of said LPC parameters and said interpolated LPC parameters to produce cross-correlation between said speech signal and an impulse response defined by said LPC parameters of said interpolated LPC parameters, said cross-correlation being representative of a correlative transition during said each search frame period, a filtering characteristic of said filtering means being varied during said each search frame period in accordance with a backward time sequence of said LPC parameters and said interpolated LPC parameters, said speech signal being received in backward time sequence; and search means for searching said plurality of pulse signals in response to said cross-correlation.

* * * * *